United States Patent [19]

Shaub

[11] Patent Number: 4,991,373

[45] Date of Patent: Feb. 12, 1991

[54] SUPPORT CLIP FOR CEILING PANELS

[76] Inventor: Melvin H. Shaub, 416 Fairway Dr., Lancaster, Pa. 17603

[21] Appl. No.: 496,758

[22] Filed: Mar. 21, 1990

[51] Int. Cl.[5] ..... E04B 1/38; E04C 5/00

[52] U.S. Cl. ..... 52/715; 52/489; 411/459

[58] Field of Search ..... 52/484, 487, 489, 715, 52/765; 411/458, 459

[56] References Cited

U.S. PATENT DOCUMENTS

| | | | |
|---|---|---|---|
| 1,974,819 | 9/1934 | Koerner | 52/484 |
| 2,851,740 | 9/1958 | Baker | 52/489 |
| 3,308,590 | 3/1967 | Ettore et al. | 52/281 |
| 3,331,180 | 7/1967 | Vissing et al. | 52/715 |
| 3,422,590 | 1/1969 | Gwynne | 52/496 |
| 4,117,644 | 10/1978 | Weinar | 52/714 |
| 4,127,975 | 12/1978 | Judkins | 52/489 |
| 4,333,286 | 6/1982 | Weinar | 52/281 |
| 4,448,007 | 5/1984 | Adams | 52/489 |
| 4,467,578 | 8/1984 | Weinar | 52/281 |
| 4,467,579 | 8/1984 | Weinar | 52/281 |
| 4,596,094 | 6/1986 | Teller et al. | 52/98 |
| 4,621,473 | 11/1986 | Wendt | 52/489 |
| 4,831,808 | 5/1989 | Wynar | 52/715 |
| 4,833,854 | 5/1989 | Paul | 52/489 |
| 4,844,651 | 7/1989 | Partridge | 403/406.1 |

FOREIGN PATENT DOCUMENTS

| | | | |
|---|---|---|---|
| 2033038 | 5/1980 | United Kingdom | 52/489 |

*Primary Examiner*—Neill R. Wilson

[57] ABSTRACT

A support clip for supporting ceiling panels in a suspended ceiling includes a top portion connected to and arranged substantially perpendicular to a front portion. A pair of juxtaposed prongs extend rearwardly from a bottom edge of the front portion below the top portion for insertion into an edge of a ceiling panel. A pair of laterally spaced tabs extend forwardly from the bottom edge of the front portion in an opposite direction from the prongs but in generally the same plane as the prongs. The tabs are positioned to rest on a wall molding which is attached to a wall of a building. A downwardly projecting barb is formed on the top portion for penetrating an upper surface of a ceiling panel.

19 Claims, 1 Drawing Sheet

SUPPORT CLIP FOR CEILING PANELS

BACKGROUND OF THE INVENTION

This invention relates generally to ceiling panel supports and, in particular, to a clip for supporting ceiling panels in buildings.

Suspended ceilings installed in buildings typically consist of a plurality of individual ceiling panels supported on a gridwork formed of wall moldings and cross supports extending along and between the walls of the building, respectively. The wall moldings are L-shaped while the cross supports have an inverted T-shape. The cross supports which extend between two of the opposite walls of the building are arranged parallel to each other but perpendicular to the cross supports which extend between the other two opposite walls of the building. This arrangement of the cross supports forms a plurality of square or rectangular openings of predetermined size in the gridwork which receive the ceiling panels. The dimensions (i.e. length and width) of these openings substantially match the dimensions (i.e. length and width) of the ceiling panels.

Ceiling panels are manufactured in standard square and rectangular sizes with what is commonly known as a "tegular" or notched edge on all four sides. These "tegular" edges have an inverted L-shape in cross section thus forming a flange or a lip that rests on the cross supports and the wall moldings of the gridwork Therefore, the ceiling panels may be quickly and easily installed after the gridwork is installed.

A problem commonly encountered when installing ceiling panels which border the walls of a building is that the openings formed in the gridwork for receiving these border panels are often odd shaped with dimensions that do not match the dimensions of standard size ceiling panels. Accordingly, it is necessary to cut standard size ceiling panels in order to make border panels which fit within these odd shaped openings in the gridwork Such cutting to make a border panel results in the "tegular" edge having to be recut on one side of the panel when installing it along a wall of a building and on two sides of the panel when installing it in a corner of a building. Recutting the "tegular" edges is a difficult and time consuming task because it must be done by hand using a tool such as a razor knife. The "tegular" edges are recut by making a vertical cut partway through the panel parallel to the new edge which has been previously made and then making a horizontal cut through the new edge intersecting the vertical cut. The horizontal cut is the most difficult.

One attempt at eliminating the recutting of "tegular" edges on ceiling panels is to use a support clip as disclosed in U.S. Pat. No. 4,833,854 granted May 30, 1989 to H. J. Paul. The clip of the Paul patent includes prongs which are inserted into the cut straight edge of a ceiling panel and support members that rest on a wall molding. However, this clip has a drawback in that it does not provide adequate stability for ceiling panels due to its lack of sufficient bearing surface against the upper surface of ceiling panels. Another drawback of the Paul clip is that it has nothing to lock the prongs into the edge of a ceiling panel as the clip is being installed. Consequently, the prongs can be easily pulled out of a ceiling panel during installation of the clip. The Paul clip also has small tabs extending above and below the prongs. A further drawback of the Paul clip is that these tabs prevent the cut straight edge of a ceiling panel from fitting tightly against a wall molding thereby permitting the undesireable passage of light rays from lighting fixtures mounted above the ceiling panel while also permitting the undesireable accummulation of dust formations.

SUMMARY OF THE INVENTION

It is an object of the present invention to provide an improved support clip which eliminates recutting of "tegular" edges on ceiling panels.

Another object of the present invention is to provide a support clip for ceiling panels which may be quickly and easily installed.

A further object of the present invention is to provide a support clip which supports ceiling panels without being easily removed from the ceiling panels during or after installation.

Still another object of the present invention is to provide a support clip which permits ceiling panels to fit snugly against wall moldings.

The present invention provides a support clip having a front portion, a top portion connected to and arranged substantially perpendicular to the front portion, prong means extending rearwardly from the front portion below the top portion, and tab means extending forwardly from the front portion. The prong means is positioned for insertion into an edge of a ceiling panel, and the tab means is positioned to rest on a wall molding which is attached to a wall of a building. The support clip may also include barb means projecting downwardly from the top portion for penetrating an upper surface of a ceiling panel. The prong means and the tab means preferably extend from a bottom edge of the front portion with the prong means disposed at an angle of slightly more than 90 degrees relative to the front portion. In the preferred embodiment of the support clip, the prong means comprises a pair of juxtaposed prongs and the tab means comprises a pair of laterally spaced tabs. In another embodiment of the support clip, the prong means comprises a pair of laterally spaced prongs and the tab means comprises a single tab.

DESCRIPTION OF THE PREFERRED EMBODIMENT

Figure 1:
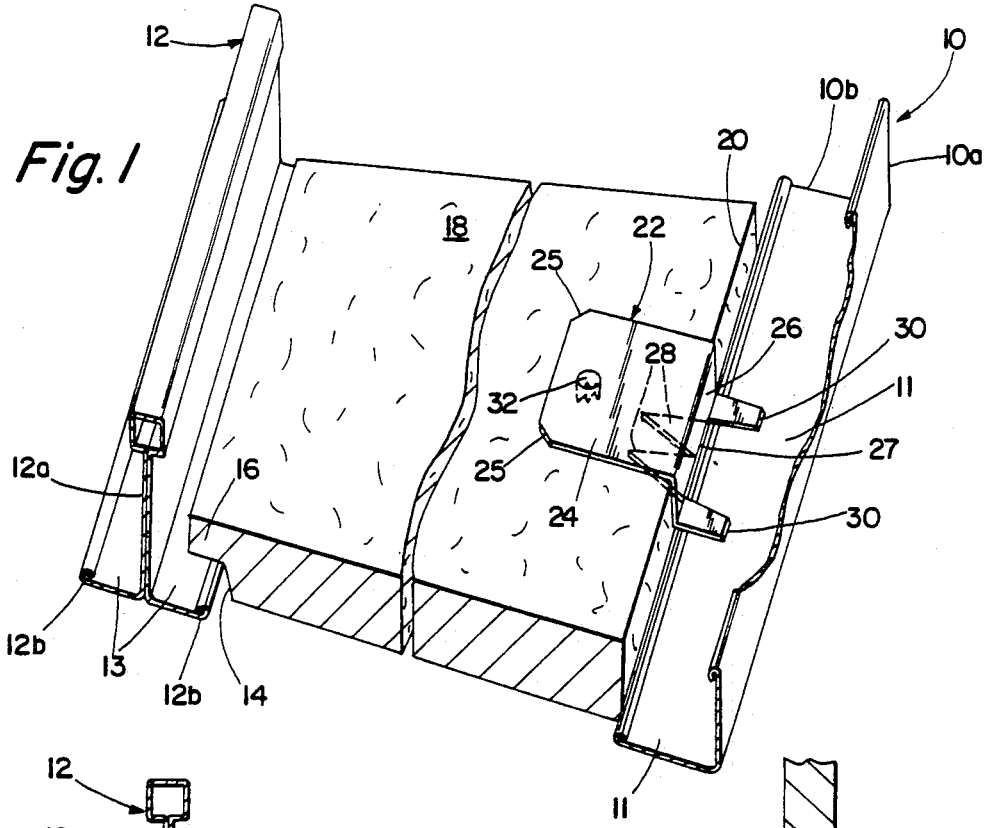
FIG. 1 is a perspective view illustrating a support clip according to the preferred embodiment of the present invention while in use supporting a ceiling panel on a wall molding.
Figure 2:
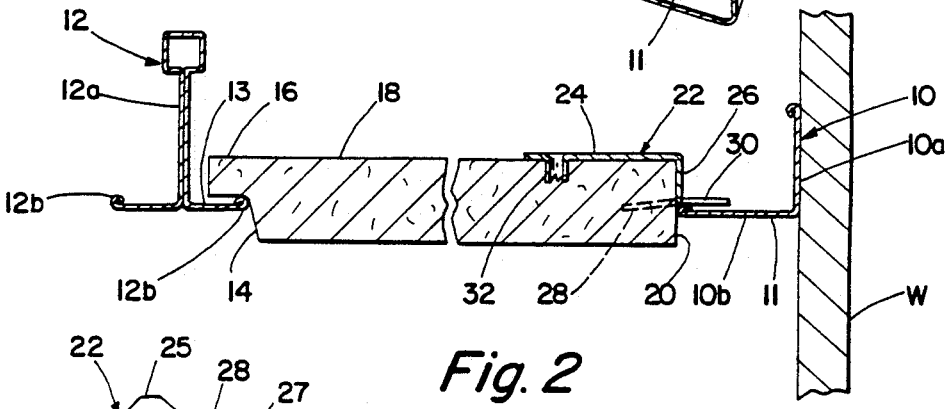
FIG. 2 is a vertical sectional view taken in FIG. 1.

Referring to FIG. 1, portions of a wall molding 10 and a cross support 12 are shown. Wall moldings 10 are attached to the interior walls of a building in which a suspended ceiling is to be installed. Cross supports 12 are strung between opposite walls of the building. Each wall molding 10 is L-shaped with a vertical leg **10*a* which abuts an interior building wall W as shown in FIG. 2 and a horizontal leg 10*b* which forms a ledge 11. Each cross support 12 has an inverted T-shape with a vertical leg 12***a* and a pair of horizontal legs 12*b* forming ledges 13.

Ceiling panels such as shown in U.S. Pat. No. 4,833,854 to H. J. Paul are supported by the wall moldings 10 and the cross supports 12. Each ceiling panel is square or rectangular and is manufactured in standard sizes with a notched edge commonly known as a "tegular" edge on all four sides. As seen in FIGS. 1 and 2, this "tegular" edge 14 has a generally inverted L-shape in cross section which forms a flange or a lip 16 that rests on the ledges 13 of the cross supports 12 when the ceiling panels are installed. The flanges 16 on the ceiling panels and the ledges 13 of the cross supports 12 overlap sufficiently to prevent any undesireable passage of light rays from lighting fixtures mounted above the ceiling panels.

In situations where standard size ceiling panels will not fit within an opening between a cross support 12 and an adjacent wall molding 10, a ceiling panel must have a portion thereof cut off as described in the aforementioned Paul patent in order to make a border panel 18 which fits the opening. This border panel 18 is cut to the proper size by using a tool such as a razor knife thereby forming a new edge 20 along at least one side of the border panel 18. However, the new edge 20 is straight rather than being notched like the "tegular" edge 14.

According to the preferred embodiment of the present invention, a support clip 22 is provided for supporting the border panel 18 after the new edge 20 has been made. The support clip 22 is formed of a suitable material such as sheet metal or plastic and includes a top portion 24 connected to and arranged substantially perpendicular to a front portion 26. A pair of juxtaposed prongs 28 extend rearwardly from a bottom edge 27 of the front portion 26 below the top portion 24. A pair of laterally spaced tabs 30 extend forwardly from the bottom edge 27 of the front portion 26 in an opposite direction from the prongs 28 but in generally the same plane as the prongs 28. A downwardly projecting barb 32 is formed on the top portion 24.

Figure 4:
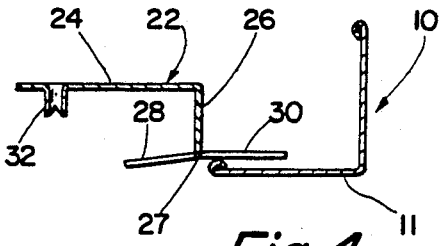
FIG. 4 is an enlarged sectional view of the support clip and the wall molding shown in FIG. 2.

In the support clip 22, the top portion 24 is substantially larger than the front portion 26 and protrudes well beyond the tips of the prongs 28. This large size of the top portion 24 significantly increases the stability of the support clip 22 by providing a relatively large bearing surface for contacting the upper surface of border panel 18. The corners of the top portion 24 opposite the front portion 26 are cut off diagonally at 25 to prevent scraping or gouging of the upper surface of border panel 18 during installation of the support clip 22. The large size of the top portion 24 also automatically aligns the support clip 22 when installing it on border panel 18. The prongs 28 are preferably disposed at an angle of slightly more than 90 degrees relative to the front portion 26 as shown in FIG. 4 to provide clearance for the barb 32 during installation of the support clip 22.

Figure 3:
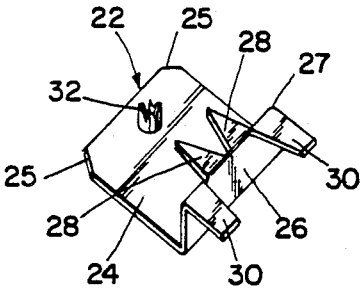
FIG. 3 is a bottom perspective view of the support clip shown in FIG. 1.

The top and front portions 24, 26 of the support clip 22 are each generally rectangular in shape having a width dimension and a length dimension as seen in FIG. 3. The width dimensions of the top and front portions 24, 26 are substantially equal but the length dimension of the top portion 24 is substantially greater than the length dimension of the front portion 26. This results in the top portion 24 being substantially larger than the front portion 26.

Once the new edge 20 has been cut along at least one side of a ceiling panel to form border panel 18, the desired number of support clips 22 are each installed by inserting the prongs 28 into the new edge 20 until the front portion 26 contacts the edge 20 and then pushing the top portion 24 downwardly against the upper surface of border panel 18 so that the barb 32 penetrates the upper surface of the border panel 18. In order to facilitate insertion of the prongs 28 into the new edge 20 of border panel 18, the tabs 30 are spaced apart a distance that will comfortably accommodate a person's finger or thumb. The support clips 22 are locked in position on border panel 18 by the combined action of the prongs 28 and the barb 32. This prevents the support clips 22 from being easily pulled out of border panel 18 during and after installation.

After the desired number of support clips 22 have been installed, border panel 18 is installed by arranging it so that the tabs 30 on the support clips 22 rest on the ledges 11 of the wall molding 10 while the flanges 16 on the "tegular" edges 14 rest on the ledges 13 of the cross supports 12. The tabs 30 are easily bendable downwardly to vertically adjust the side of border panel 18 which is adjacent wall molding 10.

Figure 5:
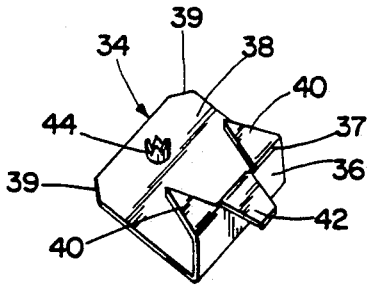
FIG. 5 is a bottom perspective view of another embodiment of the support clip of the present invention.

Referring to FIG. 5, a support clip 34 according to another embodiment of the present invention is illustrated. Support clip 34 includes a front portion 36, a top portion 38 connected to and arranged substantially perpendicular to the front portion 36, a pair of laterally spaced prongs 40 extending rearwardly from a bottom edge 37 of the front portion 36, a single tab 42 extending forwardly from the bottom edge 37 of the front portion 36, and a barb 44 extending downwardly from the top portion 38. The corners of the top portion 38 are cut off diagonally at 39. The support clip 34 is installed in the same manner as the support clip 22 by inserting the prongs 40 into the edge 20 of border panel 18 until the front portion 36 contacts the edge 20 and then pushing the top portion 38 downwardly against the upper surface of the border panel 18 so that the barb 44 engages the upper surface of the border panel 18. The tab 42 rests on the ledge 11 of wall molding 10 when border panel 18 is installed. Tab 42 may be bent downwardly to vertically adjust the side of border panel 18 adjacent wall molding 10.

It will be understood that the support clips 22 and 34 may be installed in only one manner whereas the clip disclosed in the aforementioned Paul patent may be installed in two different ways. This is an important advantage of the support clip of the present invention because suspended ceilings are often installed in poorly lit areas thereby making it difficult to visually determine whether the support clips are being installed in the proper manner.

It will also be understood that the support clip of the present invention is not limited to the embodiments disclosed herein, i.e. support clips 22 and 34. Accordingly, other embodiments may be utilized. For example, a further embodiment (not shown) would be a support clip with a single prong and a pair of laterally spaced tabs.

Since the tabs 30 and 42 of support clips 22 and 34 are bendable downwardly, the support clips 22 and 34 may be adjusted for supporting ceiling panels with "tegular" edges of different dimensions. This eliminates the need for producing the support clip of the present invention in a large number of sizes. Furthermore, some ceiling panels have "tegular" edges which cannot be recut by hand due to their physical properties. One example of this type of ceiling panel is manufactured by Armstrong World Industries under the tradename ARTRAN. The support clip of the present invention has been found to work satisfactorily with this type of ceiling panel.

What is claimed is:

1. A support clip for supporting ceiling panels in a suspended ceiling, said support clip comprising:

a front portion of generally rectangular shape having a width dimension and a length dimension;

a top portion connected to and arranged substantially perpendicular to said front portion, said top portion being of generally rectangular shape having a width dimension and a length dimension, the width dimension of said top portion being substantially equal to the width dimension of said front portion but the length dimension of said top portion being substantially greater than the length dimension of said front portion whereby said top portion is substantially larger than said front portion;

prong means extending rearwardly from said front portion below said top portion for insertion into an edge of a ceiling panel; and tab means extending forwardly from said front portion and being positioned to rest on a wall molding attached to a wall of a building.

2. The support clip of claim 1, further comprising barb means on said top portion projecting downwardly therefrom for penetrating an upper surface of a ceiling panel.

3. The support clip of claim 1, wherein said prong means and said tab means extend from a bottom edge of said front portion in substantially opposite directions.

4. The support clip of claim 1, wherein said prong means are disposed at an angle of slightly more than 90 degrees relative to said front portion.

5. The support clip of claim 1, wherein said prong means and said tab means are generally disposed in a common plane.

6. The support clip of claim 1, wherein said prong means comprises a pair of juxtaposed prongs and wherein said tab means comprises a pair of laterally spaced tabs.

7. The support clip of claim 6, wherein said prongs are located between said tabs.

8. The support clip of claim 1, wherein said prong means comprises a pair of laterally spaced prongs and wherein said tab means comprises a single tab.

9. The support clip of claim 8, wherein said single tab is located between said prongs.

10. The support clip of claim 1, wherein said top portion extends beyond the tips of said prong means in order to provide a relatively large bearing surface for contacting an upper surface of a ceiling panel.

11. The support clip of claim 10, wherein the corners of said top portion opposite said front portion are cut off diagonally.

12. The support clip of claim 1, wherein said tab means is bendable downwardly.

13. A support clip for supporting ceiling panels in a suspended ceiling, said support clip comprising:

a front portion for contacting an edge of a ceiling panel;

a top portion connected to and arranged substantially perpendicular to said front portion for contacting an upper surface of said ceiling panel, said top portion being substantially larger than said front portion;

prong means extending rearwardly from a bottom edge of said front portion below said top portion for insertion into the edge of said ceiling panel;

tab means extending forwardly from said bottom edge of said front portion and being positioned to rest on a wall molding which is attached to a wall of a building; and barb means projecting downwardly from said top portion for penetrating the upper surface of said ceiling panel.

14. The support clip of claim 13, wherein said prong means comprises a pair of juxtaposed prongs and wherein said tab means comprises a pair of laterally spaced tabs.

15. The support clip of claim 13, wherein said prong means comprises a pair of laterally spaced prongs and wherein said tab means comprises a single tab.

16. The support clip of claim 13, wherein said top portion provides a relatively large bearing surface for contacting the upper surface of said ceiling panel.

17. A support clip for supporting ceiling panels in a suspended ceiling, said support clip comprising:

a front portion;

a top portion connected to and arranged substantially perpendicular to said front portion;

prong means extending rearwardly from said front portion below said top portion for insertion into an edge of a ceiling panel;

tab means extending forwardly from said front portion and being positioned to rest on a wall molding attached to a wall of a building; and barb means on said top portion projecting downwardly therefrom for penetrating an upper surface of a ceiling panel.

18. A support clip for supporting ceiling panels in a suspended ceiling, said support clip comprising:

a front portion;

a top portion connected to an arranged substantially perpendicular to said front portion;

prong means extending rearwardly from said front portion below said top portion for insertion into an edge of a ceiling panel, said prong means being disposed at an angle of slightly more than 90 degrees relative to said front portion; and tab means extending forwardly from said front portion and being positioned to rest on a wall molding attached to a wall of a building.

19. A support clip for supporting ceiling panels in a suspended ceiling, said support clip comprising:

a front portion;

a top portion connected to and arranged substantially perpendicular to said front portion;

a pair of juxtaposed prongs extending rearwardly from said front portion below said top portion for insertion into an edge of a ceiling panel; and a pair of laterally spaced tabs extending forwardly from said front portion and being positioned to rest on a wall molding attached to a wall of a building.

* * * * *